US009091119B2

(12) United States Patent
Kim

(10) Patent No.: US 9,091,119 B2
(45) Date of Patent: Jul. 28, 2015

(54) WINDOWS AND DOORS ASSEMBLY STRUCTURE HAVING A JOINT PORTION OF 45 DEGREES

(71) Applicants: IDA CO., LTD., Jori-eup Paju-si, Gyeonggi-do (KR); Soon Seok Kim, Jori-eup Paju-si, Gyeonggi-do (KR)

(72) Inventor: Soon Seok Kim, Jori-eup Paju-si (KR)

(73) Assignee: IDA Co. Ltd., Gyeonggi-Do (KR)

( * ) Notice: Subject to any disclaimer, the term of this patent is extended or adjusted under 35 U.S.C. 154(b) by 13 days.

(21) Appl. No.: 14/356,898

(22) PCT Filed: Nov. 2, 2012

(86) PCT No.: PCT/KR2012/009164

§ 371 (c)(1),
(2) Date: May 8, 2014

(87) PCT Pub. No.: WO2013/069928

PCT Pub. Date: May 16, 2013

(65) Prior Publication Data

US 2014/0360124 A1 Dec. 11, 2014

(30) Foreign Application Priority Data

Nov. 10, 2011 (KR) ..... 10-2011-0116938

(51) Int. Cl.
*E04C 2/38* (2006.01)
*E06B 3/968* (2006.01)

(Continued)

(52) U.S. Cl.
CPC ..... *E06B 3/9688* (2013.01); *E06B 1/36* (2013.01);

(Continued)

(58) Field of Classification Search
CPC ... E06B 3/9688; E06B 3/9636; E06B 3/9687; E06B 3/9641; E06B 3/9645; E06B 3/9682; E06B 3/9646; E06B 1/36; E06B 3/22; E06B 3/12
USPC ..... 52/656.9; 403/295, 382, 401, 402
See application file for complete search history.

(56) References Cited

U.S. PATENT DOCUMENTS 4,831,804 A * 5/1989 Sayer ..... 52/475.1
2007/0053766 A1* 3/2007 Lin ..... 411/389

FOREIGN PATENT DOCUMENTS

CZ 280074 B6 * 10/1995
DE 19859381 C2 * 9/2001

(Continued)

*Primary Examiner* — Joshua J Michener
*Assistant Examiner* — Matthew Gitlin
(74) *Attorney, Agent, or Firm* — Mark M. Friedman

(57) ABSTRACT

There is provided a prefabricated window/door structure with interconnecting 45 degree joints where a horizontal bar has its both ends cut at an angle of 45 degrees and includes: a first connection space formed in the direction of the length of the horizontal bar so that the inner space of the horizontal bar is open to the outside, and a screw fastening part with a screw fastening groove protruding in the first connection space; a vertical bar has its both ends cut at an angle of 45 degrees to form a joint of 45 degrees when each of the ends of the vertical bar faces each of the ends of the horizontal bar and includes: a second connection space formed in the direction of the length of the vertical bar so that the inner space of the vertical bar is open to the outside, and a screw hole formed on a side wall in the second connection space, to be aligned with the screw fastening groove; and a support block includes: a first support part to be inserted into the first connection space of the horizontal bar and a second support part to be inserted into the second connection space of the vertical bar. The first support part includes a fastening part receiving channel formed to receive the screw fastening part when the first support part is inserted into the first connection space.

Accordingly, since the horizontal bar and the vertical bar are simply attached to and/or detached from each other, it is easy to install and repair the window/door. Further, since the thickness of the horizontal bar and the vertical bar is able to be minimized, the window/door is light in weight. In addition, the joint of the horizontal bar and the vertical bar is more strongly reinforced by the reinforcing piece(s).

1 Claim, 7 Drawing Sheets

(51) Int. Cl.

| | |
|---|---|
| ***E06B 1/36*** | (2006.01) |
| ***E06B 3/96*** | (2006.01) |
| *E06B 3/22* | (2006.01) |
| *E06B 3/964* | (2006.01) |

(52) U.S. Cl.
CPC ..... *E06B 3/9636* (2013.01); *E06B 3/22* (2013.01); *E06B 3/9645* (2013.01)

(56) References Cited

FOREIGN PATENT DOCUMENTS

| | | | |
|---|---|---|---|
| GB | 2212540 A | * | 7/1989 |
| GB | 2226353 A | * | 6/1990 |
| GB | 2265927 A | * | 10/1993 |
| GB | 2288622 A | * | 10/1995 |

* cited by examiner

WINDOWS AND DOORS ASSEMBLY STRUCTURE HAVING A JOINT PORTION OF 45 DEGREES

TECHNICAL FIELD

The present invention relates to a prefabricated window/door structure with interconnecting 45 degree joints, and more particularly, to a prefabricated window/door structure with interconnecting 45 degree joints making it easy to assemble and disassemble and minimizing the thicknesses of vertical and horizontal bars.

BACKGROUND ART

Generally, a window/door has the roles of allowing the outside light to the inside and allowing the outside air to properly ventilate the inside air. In the condition that the window/door is closed, it has the role of keeping the cooling/heating effect of the inside by blocking heat flow between the inside and the outside. As the expansion of a balcony has been legalized and the quality of the standard of living of a city dweller has been improved, it is more important for a window/door to heighten the effect of the inside interior/outside exterior design as well as to strengthen the performance of air tightness and insulation as previously explained.

Windows/doors have various facades by complexly installing fixed windows/doors and/or movable windows/doors. The movable windows/doors are structured to be opened/closed by different ways of opening/closing them by tilting, turning or sliding. Since windows/doors are able to improve the beauty in the view of the interior/exterior design, these have been widely used to a residential building, an officetel (studio apartment) building, etc.

This window/door comprises a window/door frame including a pair of horizontal bars and a pair of vertical bars forming the borders of the window/door, and a pane of glass to be fitted into the window/door frame. The window/door frames according to the conventional art are structured to have a 90 degree joint or 45 degree joint between the horizontal bar and the vertical bar.

A conventional window/door frame having 90 degree joints between a horizontal bar and a vertical bar is assembled as follows: There are prepared a pair of horizontal bars and a pair of vertical bars being each wider than each horizontal bar in width. Next, holes are cut in upper and lower ends of the inner side of each of the vertical bars so that both ends of each of the horizontal bars are fitted into the holes. The horizontal bars are fitted into the holes cut into the vertical bars so that these bars maintain a square frame. The horizontal bars and vertical bars are fixed by using screws. In this conventional window/door frame, since the both ends of each of the horizontal bars are primarily fitted into the both ends of each of the vertical bars and these connected parts are fastened using the screws, the connection of the horizontal bars and vertical bars is relatively strong.

However, in this conventional window/door frame, since the width of the vertical bar is greater than the width of the horizontal bar to fit the horizontal bar into the hole cut into the vertical bar, a raised step occurs in the joint of the vertical bar and the horizontal bar. That is, since the raised step occurs in the joint of the vertical bar and the horizontal bar, a sense of beauty of the window/door frame greatly decreases. Further, in the case where pattern is formed on the surfaces of the vertical bars and the horizontal bars, the pattern formed on the surfaces of the vertical bars and the pattern formed on the surfaces of the horizontal bars fails to continue and disconnects by the raised step of the joints, lessing the sense of beauty.

A prefabricated window/door structure with 45 degree joints has been developed because of the aforementioned problems of the prefabricated window/door structure with the 90 degree joints. In the prefabricated window/door structure with 45 degree joints, both ends of a vertical bar are cut at an angle of 45 degrees and both ends of a horizontal bar are cut at an angle of 45 degrees. One of the ends of the vertical bar being cut at an angle of 45 degrees faces one of the ends of the horizontal bar being cut at an angle of 45 degrees. In this case, since the thickness of the vertical bar is the same as the thickness of the horizontal bar, no raised step occurs between them. A "]"-shaped fixing piece is inserted into the corner where the vertical bar is connected with the horizontal bar. Then, the fixing piece is punched to increase the thickness of the fixing piece at the part being punched. The joint of the vertical bar and the horizontal bar is secured by the thickness of the fixing piece.

However, the prefabricated window/door structure with 45 degree joints has the problems:

First, the thickness of the vertical bar and the horizontal bar need to be thick in order to properly secure the joint of the vertical bar and the horizontal bar by pressurizing a specific part of the fixing piece and forcibly increasing the thickness of the pressurized part. If the thickness of the vertical bar and the horizontal bar is thin, the parts of the vertical bar and horizontal bar being secured by the fixing piece separate when the thickness of the fixing piece changes. Therefore, the fixing piece is not tightly fixed inside the vertical bar and horizontal bar. Furthermore, since flowage can occur between the vertical bar and horizontal bar and the fixing piece even by a slight impact, the fixing piece loosens from the joint of the vertical bar and horizontal bar and flowage occurs in the joint. Therefore, the thickness of the vertical bar and horizontal bar needs to be thick to properly fix the vertical bar and horizontal bar by punching the fixing piece. If the thickness of the vertical bar and horizontal bar increases, the binding power with the fixing piece increases but the total weight of the window/door frame increases and therefore it is difficult to be assembled, transported or installed. In addition, the manufacturing unit price is also increased.

Second, when the fixing piece is inserted in the joint of the vertical bar and horizontal bar and it is fixed by punching, it is impossible to separate them again. Therefore, once the window/door fame with 45 degree joints is assembled, it cannot be disassembled. That is, since the prefabricated window/door structure with 45 degree joints is impossible to be disassembled once it is assembled, it is very difficult to maintain or repair it.

DISCLOSURE

Technical Problem

Therefore, it is an object of the present invention to solve the above problems and to provide a prefabricated window/door structure with interconnecting 45 degree joints which is easily assembled and/or disassembled.

It is another object of the present invention to provide a prefabricated window/door structure with interconnecting 45 degree joints which makes it possible to minimize the thickness of a vertical bar and horizontal bar.

Technical Solution

In accordance with one embodiment of the present invention, there is provided a prefabricated window/door structure with interconnecting 45 degree joints wherein a pair of vertical bars and a pair of horizontal bars each connected to upper ends and lower ends of the vertical bars form a window/door frame holding a pane of glass or security window/door and a joint of the vertical bar and the horizontal bar forms an angle of 45 degrees, the window/door structure comprising: a pair of horizontal bars, a pair of vertical bars, a support block to be inserted in the joint of the horizontal bar and the vertical bar, and a joint screw to be fastened to the joint of the horizontal bar and the vertical bar. In this invention, the horizontal bar has its both ends cut at an angle of 45 degrees and includes: a first connection space formed in the direction of the length of the horizontal bar so that the inner space of the horizontal bar is open to the outside, and a screw fastening part with a screw fastening groove protruding in the first connection space. The vertical bar has its both ends cut at an angle of 45 degrees to form a joint of 45 degrees when each of the ends of the vertical bar faces each of the ends of the horizontal bar and includes: a second connection space formed in the direction of the length of the vertical bar so that the inner space of the vertical bar is open to the outside, and a screw hole formed on a side wall in the second connection space, to be aligned with the screw fastening groove. The support block includes: a first support part to be inserted into the first connection space of the horizontal bar and a second support part to be inserted into the second connection space of the vertical bar, wherein the first support part includes a fastening part receiving channel formed to receive the screw fastening part when the first support part is inserted into the first connection space. The joint screw is fastened to the screw fastening part of the horizontal bar and the side wall of the vertical bar to connect the horizontal bar and the vertical bar.

In accordance with the other embodiment of the present invention, there is provided a prefabricated window/door structure with interconnecting 45 degree joints wherein a pair of vertical bars and a pair of horizontal bars each connected to upper ends and lower ends of the vertical bars form a window/door frame holding a pane of glass or security window/door and a joint of the vertical bar and the horizontal bar forms an angle of 45 degrees, the window/door structure comprising: a pair of horizontal bars, a pair of vertical bars, a reinforcing piece to be inserted in the joint of the horizontal bar and the vertical bar to reinforce and prevent warping of the joint, and a joint screw to be fastened to the joint of the horizontal bar and the vertical bar. In this invention, the horizontal bar has its both ends cut at an angle of 45 degrees and includes: a first connection space formed in the direction of the length of the horizontal bar so that the inner space of the horizontal bar is open to the outside, a screw fastening part with a screw fastening groove protruding in the first connection space, and first reinforcing part receiving channels respectively formed at both inner sides of the horizontal bar. The vertical bar has its both ends cut at an angle of 45 degrees to form a joint of 45 degrees when each of the ends of the vertical bar faces each of the ends of the horizontal bar and includes: a second connection space formed in the direction of the length of the vertical bar so that the inner space of the vertical bar is open to the outside, a screw hole formed on a side wall of the second connection space, to be aligned with the screw fastening groove, and second reinforcing part receiving channels respectively formed at both inner sides of the vertical bar. The reinforcing piece includes: a first reinforcing part to be inserted into the first reinforcing part receiving channel of the horizontal bar, and a second reinforcing part to be inserted into the second reinforcing part receiving channel of the vertical bar. The joint screw is fastened to the screw fastening part of the horizontal bar and the side wall of the vertical bar to connect the horizontal bar and the vertical bar.

Preferably, more than one screw fastening part may be formed in the first connection space of the horizontal bar and a corresponding number of the screw holes to the number of the screw fastening parts may be formed in the side wall of the vertical bar.

Advantageous Effects

In the prefabricated window/door structure with interconnecting 45 degree joints according to the present invention, the horizontal bar and the vertical bar is strongly connected without warping of the joint of the horizontal bar and the vertical bar only by inserting the support block into the first connection space of the horizontal bar and the second connection space of the vertical bar and fastening the joint screw to the joint of the horizontal bar and the vertical bar. The horizontal bar, the vertical bar and the support block are simply separated only by loosening the joint screw. Therefore, since the horizontal bar and the vertical bar are simply connected and separated, it is very easy to install and repair the window/door.

In the prefabricated window/door structure with interconnecting 45 degree joints according to the present invention, the horizontal bar and the vertical bar are connected by connecting the support block to the first connection space of the horizontal bar and the second connection space of the vertical bar to strengthen the joint of the horizontal bar and the vertical bar and by fastening the joint screw to the screw fastening part of the horizontal bar and the side wall including the screw holes of the vertical bar to fasten the joint thereof. Therefore, the joint of the horizontal bar and the vertical bar is assembled using the joint screw and simultaneously it is strengthened by the securing of the support block. Accordingly, since the horizontal bar and the vertical bar are strongly assembled without applying any excessive force, excessive thickness of the horizontal bar and the vertical bar is not required. Thus, since the prefabricated window/door structure of the present invention minimizes the thickness of the horizontal bar and the vertical bar, it is light in weight, work is improved and its manufacturing unit price is remarkably reduced.

In the prefabricated window/door structure with interconnecting 45 degree joints according to the present invention, since the reinforcing pieces are inserted into the first reinforcing part receiving channels of the horizontal bar and the second reinforcing part receiving channels of the vertical bar, the joint of the horizontal bar and the vertical bar is definitely reinforced by a pair of the reinforcing pieces and therefore the window/door frame is prevented from warping. Since these reinforcing pieces are not directly fixed to the horizontal bar and the vertical bar but simply inserted into these bars, assembling and disassembling are very simple.

In the prefabricated window/door structure with interconnecting 45 degree joints according to the present invention, more than one the screw fastening part is formed in the first connection space of the horizontal bar and a corresponding number of the screw holes are formed in the side wall of the vertical bar. Therefore, since the horizontal bar and the vertical bar are strongly connected by more than one joint screw through the corresponding screw fastening parts and the corresponding screw holes, the durability of the product is improved.

DESCRIPTION OF DRAWINGS

These and other aspects and advantages of the present invention will become apparent and more readily appreciated from the following description of the embodiment(s), taken in conjunction with the accompanying drawings, in which.

DETAILED DESCRIPTION OF THE INVENTION

The technical characteristics of the present invention will be specifically described with reference to the accompanying drawings.

Figure 1:
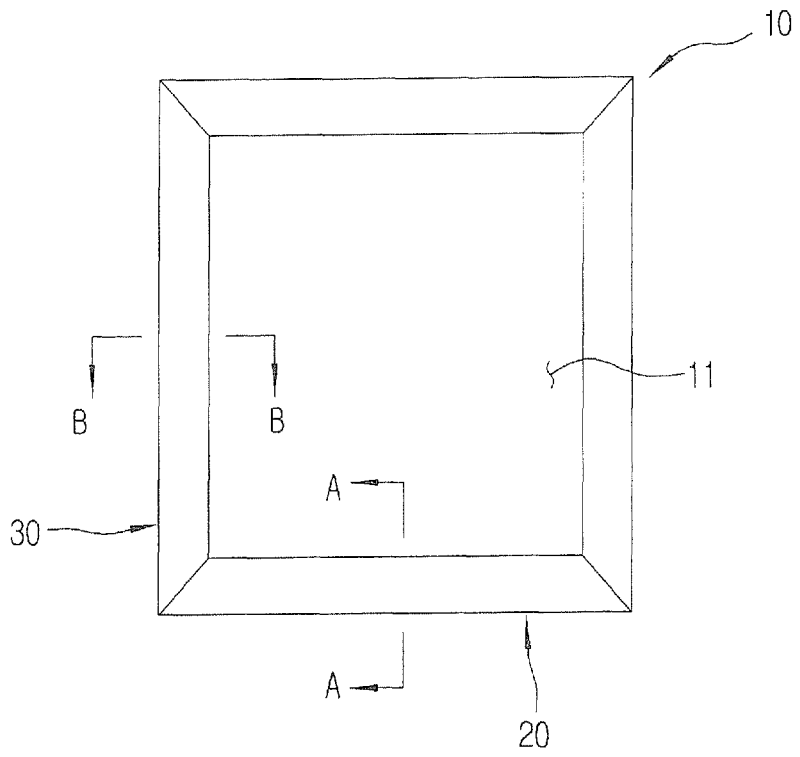
FIG. 1 is a front view of a prefabricated window/door structure with interconnecting 45 degree joints according to a first embodiment of the present invention.
Figure 2:
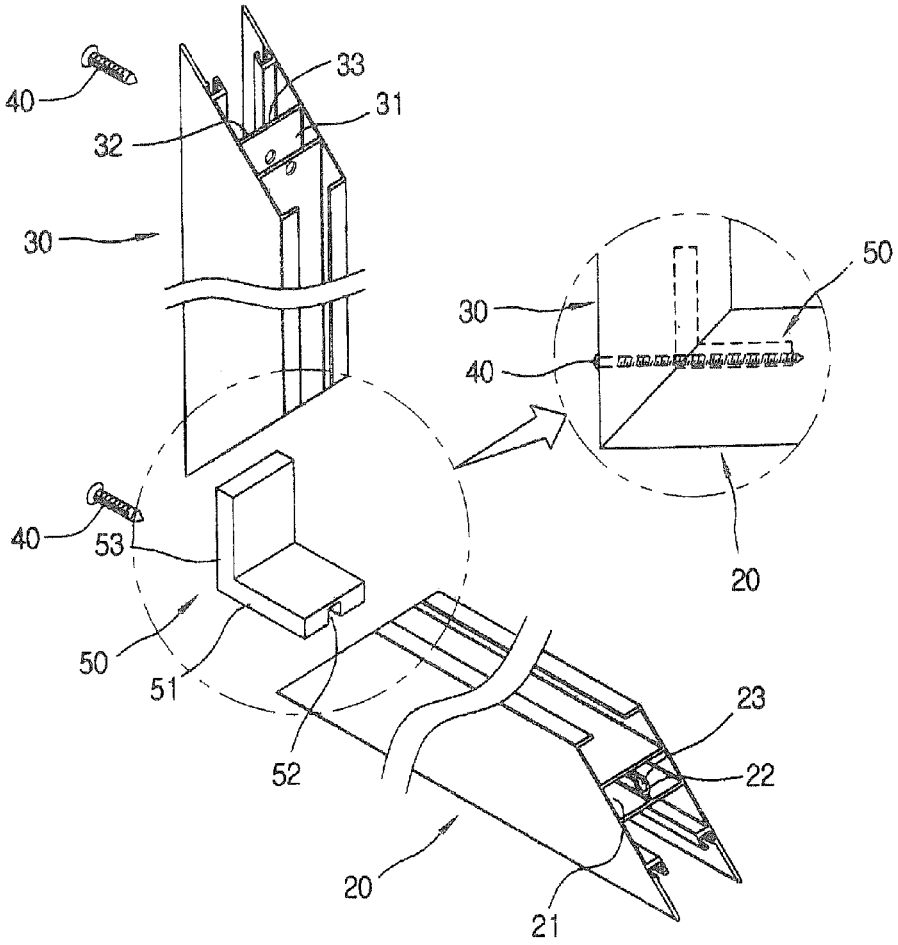
FIG. 2 is a partially exploded perspective view of FIG. 1.
Figure 3:
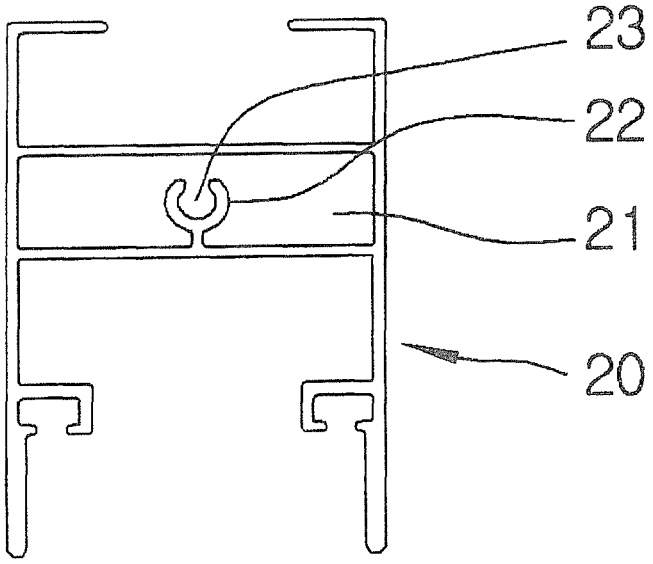
FIG. 3 is a sectional view taken along a Line A-A in FIG. 1.
Figure 4:
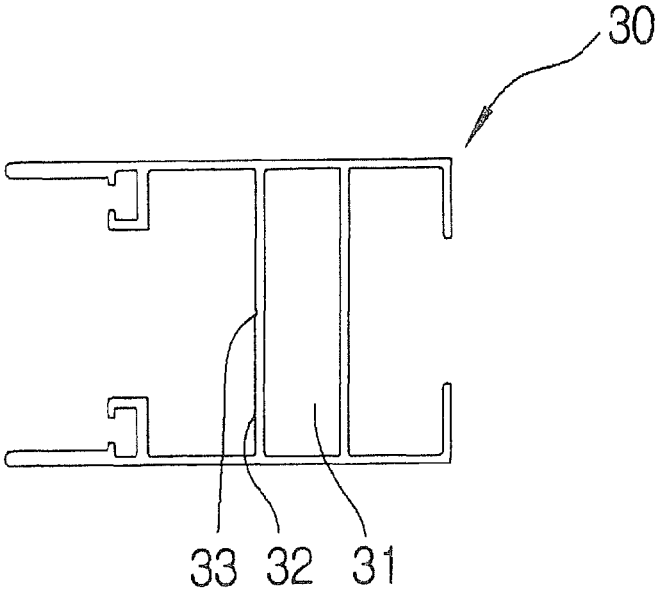
FIG. 4 is a sectional view taken along a Line B-B in FIG. 1.

FIG. 1 is a front view of a prefabricated window/door structure with interconnecting 45 degree joints according to a first embodiment of the present invention, FIG. 2 is a partially exploded perspective view of FIG. 1, FIG. 3 is a sectional view taken along a Line A-A in FIG. 1 and FIG. 4 is a sectional view taken along a Line B-B in FIG. 1.

The prefabricated window/door structure with interconnecting 45 degree joints according to the first embodiment of the present invention comprises: a pair of vertical bars 30 and a pair of horizontal bars 20 which are respectively connected with the vertical bars 30 at an upper end and an lower end of each of the vertical bar 30, to form a window/door frame 10 supporting a pane of glass 11 or a security grille. The joint of the vertical bar 30 and the horizontal bar is formed at an angle of 45 degrees. The prefabricated window/door structure with interconnecting 45 degree joints further comprises: supporting blocks 50 inserted into the joints of the horizontal bars 20 and the vertical bars 30, joint screws 40 fastened in the joints of the horizontal bars 20 and the vertical bars 30.

Both ends of the horizontal bar 20 are cut at an angle of 45 degrees. A first connection space 21 is formed in the direction of the length of the horizontal bar 20 so that the inner space of the horizontal bar 20 is open to the outside. A screw fastening part 22 with a screw fastening groove 23 protrudes in the first connection space 21.

Both ends of the vertical bar 30 are cut at an angle of 45 degrees to form a joint of 45 degrees when each of the ends of the vertical bar 30 faces each of the ends of the horizontal bar 20. A second connection space 31 is formed in the direction of the length of the vertical bar 30 so that the inner space of the vertical bar 30 is open to the outside. A screw hole 33 is formed in side wall 32 in the second connection space 31, to be aligned with the screw fastening groove 23.

The support block 50 includes a first support part 51 to be inserted into the first connection space 21 of the horizontal bar 20 and a second support part 53 to be inserted into the second connection space 31 of the vertical bar 30. The first support part 51 includes a fastening part receiving channel 52 formed to receive the screw fastening part 22 when the first support part 51 is inserted into the first connection space 21. The joint screw 40 is fastened to the side wall 32 of the vertical bar 30 and the screw fastening part 22 of the horizontal bar 20, to connect the vertical bar 30 and the horizontal bar 20.

The prefabricated window/door structure with interconnecting 45 degree joints according to the present invention has the features that:

First, when the support block 50 is inserted into the first connection space 21 of the horizontal bar 20 and the second connection space 31 of the vertical bar 30 and the joint screw 40 is fastened to the joint of the horizontal bar 20 and the vertical bar 30, the joint of the horizontal bar 20 and the vertical bar 30 is strongly secured without warping. Further, the horizontal bar 20 and the vertical bar 30 and the support block 50 are simply disassembled only by loosening the joint screw 40. Therefore, since the horizontal bar 20 and the vertical bar 30 are easily connected and separated, it is easy to install and repair the window/door.

Second, in the prefabricated window/door structure of the present invention, the horizontal bar 20 and the vertical bar 30 are connected by connecting the support block 50 to the first connection space 21 of the horizontal bar 20 and the second connection space 31 of the vertical bar 30 to strengthen the joint of the horizontal bar 20 and the vertical bar 30 and by fastening the joint screw 40 to the screw fastening part 22 of the horizontal bar 20 and the side wall 32 with the screw hole 33 of the vertical bar 30 to secure the joint thereof. Therefore, the joint of the horizontal bar 20 and the vertical bar 30 is assembled by using the joint screw 40 and simultaneously it is strengthened by the securing of the support block 50. Accordingly, since the horizontal bar 20 and the vertical bar 30 are strongly assembled without applying any excessive force, excessive thickness of the horizontal bar 20 and the vertical bar 30 is not required. Thus, since the prefabricated window/door structure of the present invention minimizes the thickness of the horizontal bar 20 and the vertical bar 30, it is light in weight, work is improved and its manufacturing unit price is reduced.

Third, the screw hole 33 is formed on the side wall 32 of the vertical bar 30 so that the joint screw 40 is easily secured to the screw fastening part 22. Therefore, the horizontal bar 20 and the vertical bar 30 are connected by a single fastening process, making it easy to assemble and reducing assembly time.

Figure 5:
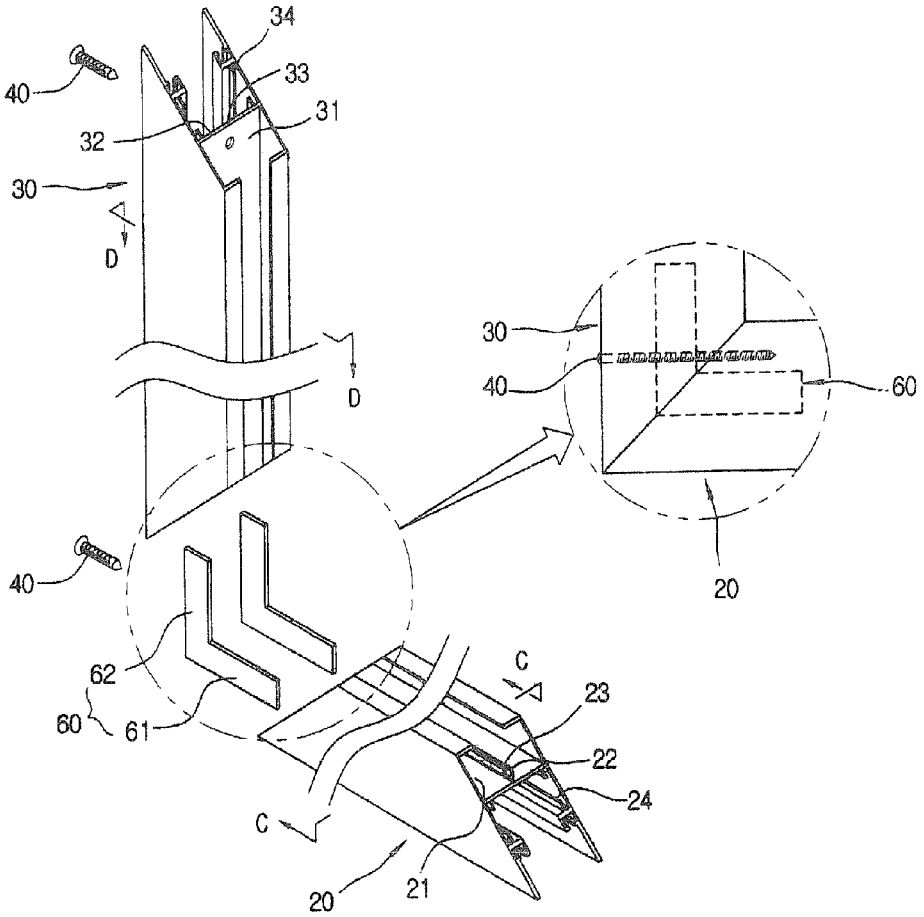
FIG. 5 is a partially exploded perspective view of a prefabricated window/door structure with interconnecting 45 degree joints according to a second embodiment of the present invention.
Figure 6:
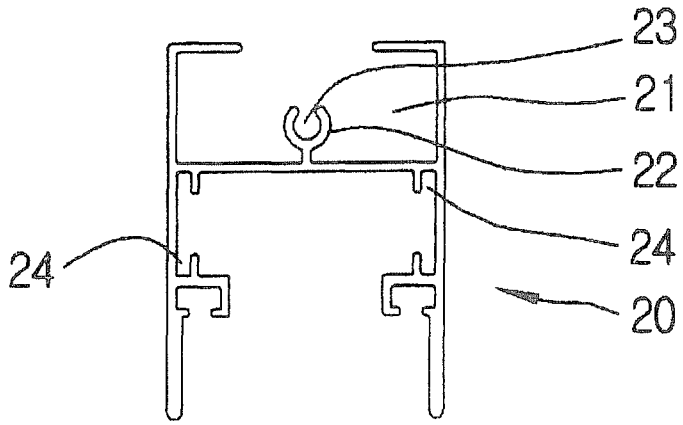
FIG. 6 is a sectional view taken along a Line C-C in FIG. 5.
Figure 7:
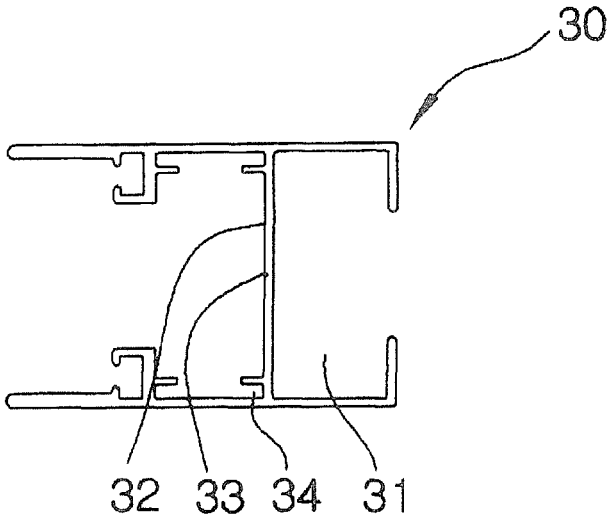
FIG. 7 is a sectional view taken along a Line D-D in FIG. 5.

FIG. 5 is a partially exploded perspective view of a prefabricated window/door structure with interconnecting 45 degree joints according to a second embodiment of the present invention, FIG. 6 is a sectional view taken along a Line C-C in FIG. 5, and FIG. 7 is a sectional view taken along a Line D-D in FIG. 5. The prefabricated window structure with interconnecting 45 degree joints according to the second embodiment of the present invention comprises: a pair of horizontal bars 20, a pair of vertical bars 30, reinforcing pieces 60 inserted into the joints of the horizontal bars 20 and the vertical bars 30 to reinforce and prevent warping of the joints, and joint screws 40 to be fastened to the joints of the horizontal bars 20 and the vertical bars 30.

Both ends of the horizontal bar 20 are cut at an angle of 45 degrees. A first connection space 21 is formed in the direction of the length of the horizontal bar 20 so that the inner space of the horizontal bar 20 is open to the outside. A screw fastening part 22 with a screw fastening groove 23 protrudes in the first connection space 21. First reinforcing part receiving channels 24 are respectively formed at both inner sides of the horizontal bar 20.

Both ends of the vertical bar 30 are cut at an angle of 45 degrees to form a joint of 45 degrees when each of the ends of the vertical bar 30 faces each of the ends of the horizontal bar 20. A second connection space 31 is formed in the direction of the length of the vertical bar 30 so that the inner space of the vertical bar 30 is open to the outside. A screw hole 33 is formed in a side wall 32 in the second connection space 31, to be aligned with the screw fastening groove 23. Second reinforcing part receiving channels 34 are respectively formed at both inner sides of the vertical bar 30.

The reinforcing pieces 60 includes: a first reinforcing part 61 to be inserted into the first reinforcing part receiving channel 24 of the horizontal bar 20 and a second reinforcing part 62 to be inserted into the second reinforcing part receiving channel 34 of the vertical bar 30. The joint screw 40 is fastened to the screw fastening part 22 of the horizontal bar 20 and the side wall 32 of the vertical bar 30, to connect the horizontal bar 20 and the vertical bar 30.

The prefabricated window/door structure with interconnecting 45 degree joints according to the second embodiment of the present invention is characterized in that the first reinforcing part receiving channels 24 are formed in the horizontal bar 20 and the second reinforcing part receiving channels 34 are formed in the vertical bar 30 and the reinforcing pieces 60 are inserted into the first reinforcing part receiving channels 24 and the second reinforcing part receiving channels 34. Since the other constitution and effects of the prefabricated window/door structure according to the second embodiment are the same as or identical with those described with reference to FIGS. 1 through 4, no further detailed description is present.

In the prefabricated window/door structure according to the second embodiment, since the joint of the horizontal bar 20 and the vertical bar 30 is definitely reinforced by the reinforcing pieces 60, the window/door frame 10 is prevented from warping. These reinforcing pieces 60 are not directly fixed to the horizontal bar 20 and the vertical bar 30 but simply inserted into them. Therefore, when the reinforcing pieces 60 are connected to or separated from the first reinforcing part receiving channels 24 and the second reinforcing part receiving channels 34, it is very simple to assemble and/or disassemble without any additional joint work.

Figure 8:
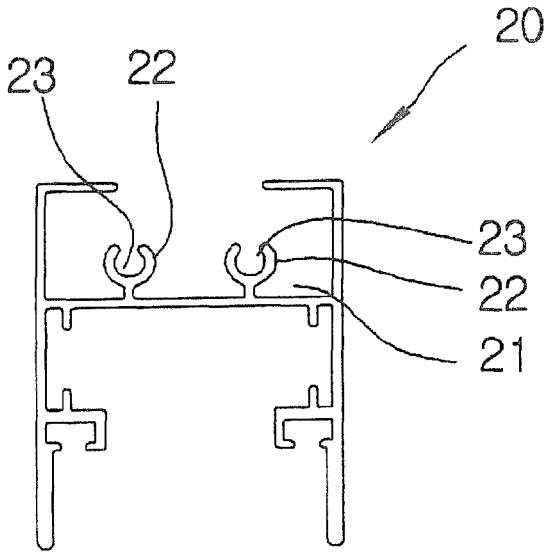
FIGS. 8 and 9 are schematic sectional views of a vertical bar and horizontal bar according to a modified example of the present invention.
Figure 9:
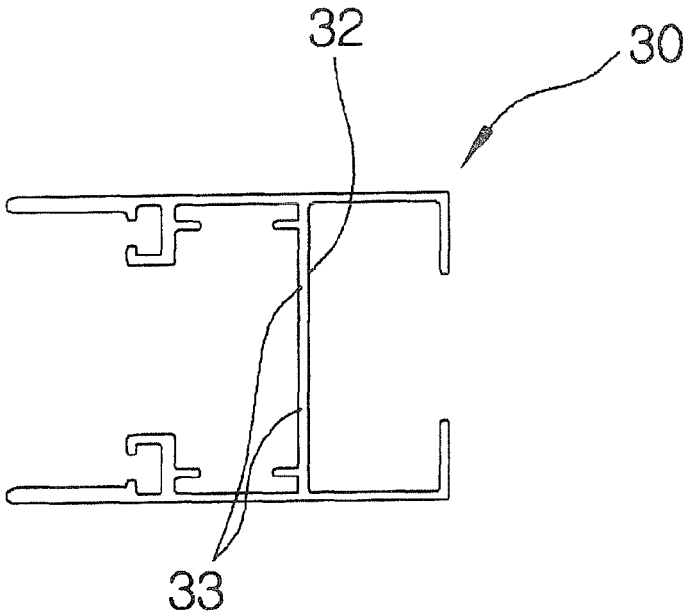

FIGS. 8 and 9 are respectively schematic sectional views of a vertical bar and horizontal bar according to a modified example of the present invention. The first connection space 21 of the horizontal bar 20 may include more than one screw fastening part 22. The side wall 32 of the vertical bar 30 includes a corresponding number of screw holes 33 to the number of the screw fastening parts 22. Therefore, the horizontal bar 20 and the vertical bar 30 are firmly connected by more than one joint screw 40 though the corresponding screw fastening parts 22 and the corresponding screw holes 33, to improve the durability of the product.

Figure 10:
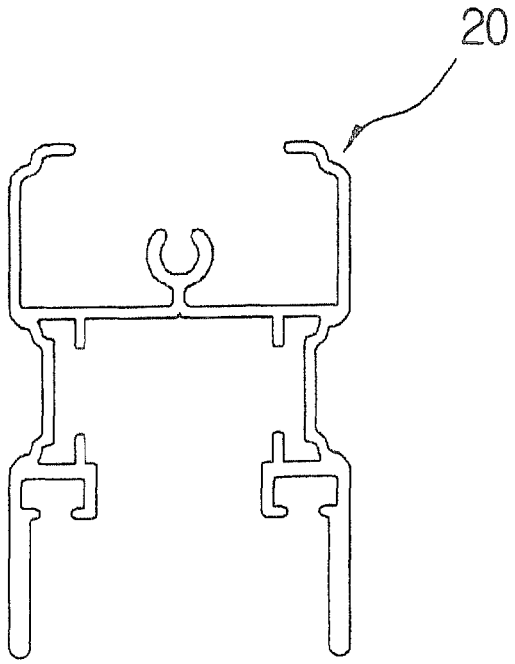
FIGS. 10 and 11 are schematic sectional views of the vertical bar and horizontal bar with their improved appearance by shaping their outer surfaces.
Figure 11:
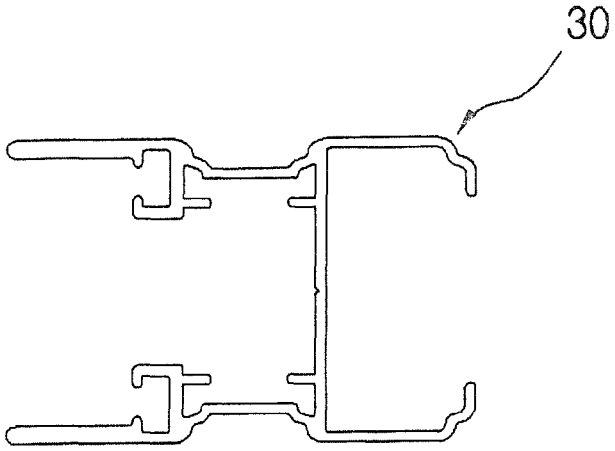

FIGS. 10 and 11 are respectively schematic sectional views of the vertical bar and horizontal bar with their improved appearance by shaping their outer surfaces. The functions of the horizontal bar 20 and the vertical bar 30 are identical with those described with reference to FIGS. 1 through 9, except for their shaped outer surfaces to improve the sense of beauty. These outer surfaces also improve the entire sense of beauty of the prefabricated window/door structure.

The invention claimed is:

1. A prefabricated window or door structure with interconnecting 45 degree joints wherein a pair of vertical bars and a pair of horizontal bars each connected to upper ends and lower ends of the vertical bars form a window or door frame holding a pane of glass or security window or door and a joint of the vertical bar and the horizontal bar forms an angle of 45 degrees, the window or door structure comprising:

a pair of horizontal bars (20), a pair of vertical bars (30), at least one reinforcing piece (60) to be inserted in the joint of the horizontal bar (20) and the vertical bar (30), to reinforce and prevent warping of the joint, and at least one joint screw (40) to be fastened to the joint of the horizontal bar (20) and the vertical bar (30), wherein the horizontal bar (20) has both ends cut at an angle of 45 degrees and includes:

a first connection space (21) formed in the direction of the length of the horizontal bar (20) so that the inner space of the horizontal bar (20) is open to the outside, at least one screw fastening part (22) with a screw fastening groove (23) protruding in the first connection space (21), and a plurality of first reinforcing part receiving channels (24) respectively formed at both inner sides of the horizontal bar (20);

the vertical bar (30) has both ends cut at an angle of 45 degrees to form a joint of 45 degrees when each of the ends of the vertical, bar (30) faces each of the ends of the horizontal bar (20) and includes:

a second connection space (31) formed in the direction of the length of the vertical bar (30) so that the inner space of the vertical bar (30) is open to the outside, a screw hole (33) formed on a side wall (32) in the second connection space (31), to be aligned with the screw fastening groove (23), and a plurality of second reinforcing part receiving channels (34) respectively formed at both inner sides of the vertical bar (30);

the at least one reinforcing piece (60) includes:

a first reinforcing part (61) to be inserted into one of the plurality of the first reinforcing part receiving channels (24) of the horizontal bar (20), and a second reinforcing part (62) to be inserted into one of the plurality of the second reinforcing part receiving channels (34) of the vertical bar (30), and the at least one joint screw (40) is inserted through the screw hole (33) formed in the sidewall of a second connection space (31) of a vertical bar (30) and fastened into the screw fastening groove (23) protruding from the sidewall of a first connection space (21) of the horizontal bar (20) and the side wall (32) of the vertical bar (30) to connect the horizontal bar (20) and the vertical bar (30), and wherein the at least one screw fastening part (22) is formed in the first connection space (21) of the horizontal bar (20) and a corresponding number of the screw holes (33) to the number of the screw fastening parts (22) are formed in the side wall (32) of the vertical bar (30).

* * * * *